US005465926A

United States Patent [19]

Brown

[11] Patent Number: 5,465,926

[45] Date of Patent: Nov. 14, 1995

[54] CODED TRACK CIRCUIT REPEATER HAVING STANDBY MODE

[75] Inventor: James P. Brown, Allison Park, Pa.

[73] Assignee: Union Switch & Signal Inc., Pittsburgh, Pa.

[21] Appl. No.: 260,537

[22] Filed: Jun. 16, 1994

Related U.S. Application Data

[63] Continuation of Ser. No. 958,501, Oct. 8, 1992, abandoned.

[51] Int. Cl.[6] ..... B61L 21/08; B61L 23/22

[52] U.S. Cl. ..... 246/34 B; 246/122 R; 340/825.54

[58] Field of Search ..... 340/291, 425, 340/825.54; 246/3, 4, 5, 34 R, 34 A, 34 CT, 34 B, 14, 15, 122 R

[56] References Cited

U.S. PATENT DOCUMENTS

| | | | |
|---|---|---|---|
| 3,593,022 | 7/1971 | Hoyler et al. | 246/5 X |
| 3,753,228 | 8/1973 | Nickolas et al. | 340/146 |
| 3,794,977 | 2/1974 | Thorne-Booth et al. | 246/5 X |
| 4,305,556 | 12/1981 | Norton et al. | 246/5 |
| 4,369,942 | 1/1983 | Wilson | 246/34 R X |
| 4,415,134 | 11/1983 | Wilson | 246/34 |
| 4,437,632 | 3/1984 | Pascoe | 246/34 A X |
| 4,498,650 | 2/1985 | Smith et al. | 246/122 |
| 4,550,889 | 11/1985 | Emmel | 246/3 X |
| 4,619,425 | 10/1986 | Nagel | 246/34 |
| 4,723,739 | 2/1988 | Franke | 246/34 |
| 4,886,226 | 12/1989 | Frielinghaus | 246/34 R X |
| 5,145,131 | 9/1992 | Franke | 246/122 |
| 5,194,846 | 3/1993 | Lee et al. | 340/825.54 X |

FOREIGN PATENT DOCUMENTS

| | | | |
|---|---|---|---|
| 1204449 | 1/1986 | U.S.S.R. | 246/34 CT |
| 2208449 | 3/1989 | United Kingdom | 246/34 R |

*Primary Examiner*—Michael S. Huppert
*Assistant Examiner*—Scott L. Lowe
*Attorney, Agent, or Firm*—Buchanan Ingersoll; Michael L. Dever

[57] ABSTRACT

A coded railway track circuit apparatus is disclosed having the capability of operating during periods of low vehicle activity in a reduced power standby mode. This is accomplished by switching circuitry which interrupts power to most of the components within the track circuit apparatus in response to the recognition by standby initiation circuitry of a preselected standby initiation signal. Power to fail-over indicators which would normally be activated due to a power failure is also interrupted by fail-over interrupt circuitry. During the standby mode, monitor circuitry remains active to recognize occurrence of a preselected wake-up signal. When the wake-up signal is received, full power is restored, thus resuming normal operation. Operation of the fail-over systems is also then re-established.

15 Claims, 3 Drawing Sheets

CODED TRACK CIRCUIT REPEATER HAVING STANDBY MODE

This application is a continuation of application Ser. No. 07/958,501, filed Oct. 8, 1992, now abandoned.

BACKGROUND OF THE INVENTION

1. Field of the Invention.

The present invention relates to a method and means for reducing power consumption in a coded railway track circuit. More particularly, the invention relates to a method and means for placing a coded railway track circuit apparatus into a reduced power standby mode during periods of low vehicle activity.

2. Description of the Prior Art.

In the art of railway signalling, traffic flow through signalled territory is typically directed by various signal aspects appearing on wayside indicators or cab signal units located on board the vehicles. The vehicle operators recognize each such aspect as indicating a particular operating condition allowed at that time. Typical practice is for the aspects to indicate prevailing speed conditions.

For operation of this signaling scheme, the track is typically divided into cascaded sections known as "blocks." These blocks, which may be generally as long as two to three miles, are electrically isolated from adjacent blocks typically utilizing interposing insulated joints. When a block is unoccupied, track circuit apparatus connected at each end are able to transmit signals back and forth through the rails within the block. Such signals may be coded to contain control data enhancing the signalling operation. Track circuits operating in this manner are referred to as "coded track circuits." One such coded track circuit is illustrated in U.S. Pat. No. 4,619,425, issued Oct. 28, 1986 to Nagel. When a block is occupied by a railway vehicle, shunt paths are created across the rails by the vehicle wheel and axle sets. While this interrupts the flow of information between respective ends of the block, the presence of the vehicle can be positively detected.

Generally, coded track circuit apparatus can be functionally categorized into two types depending on their location within the signalled territory. The first type are end units, which have a separate communication link to the railway dispatching office or other central vehicle control location. These units are often placed at industrial sidings or highway crossings and are thus convenient to commercial power hookup. The second type are intermediate units which are connected to rails in adjacent blocks, thus coupling information around the insulated joints. In this way, ultimate communication between end units is facilitated. Often, these intermediate units are located in remote areas. Powering these intermediate units has often required installation of lengthy and expensive stretches of buried or pole-mounted cable.

The need to install power cables to intermediate units can be eliminated in some areas using self-contained battery systems which may be charged by solar panels. Present intermediate units, however, have consumed power at a rate requiring such battery systems to have significant capacity. Since the cost of these battery systems is directly related to power capacity, a significant disincentive has existed for their use. Even when power cables are run to the intermediate units, storage batteries are required at each location to provide backup power in the event of commercial power failure. The size and cost of these batteries also depend directly on average power consumption.

SUMMARY OF THE INVENTION

According to the invention, coded railway track circuit apparatus electrically connected to adjacent track blocks may be placed into a standby mode during periods of low vehicle activity in order to reduce overall power consumption. In presently preferred embodiments, the standby mode is effectuated by interrupting power to most of the components within the track circuit apparatus in response to a preselected standby initiation signal. Power to fail-over indicators which would normally actuate when the track circuit apparatus shuts down is also preferably interrupted. During the standby mode, rails in the adjacent track blocks are monitored for occurrence of a preselected wake-up signal. When the wake-up signal is received, normal operation of the track circuit apparatus is resumed. Operation of the fail-over systems may also be re-established at this time.

A device practicing the invention may be incorporated into coded track circuit apparatus at the time of manufacture or installed later as a retrofit. Preferably, such a device includes a number of circuit networks dedicated to particular functions. For example, standby initiation circuitry may be provided to receive and identify the standby initiation signal. When the standby initiation signal is received, appropriate switching circuitry may then establish the standby mode. In presently preferred embodiments, this is accomplished by producing a signal directing shut down of the track circuit apparatus power supply and actuating fail-over interrupt circuitry to suspend continuity in an energy supply line used to power fail-over systems.

During the standby mode, monitor circuitry remains active to detect the wake-up signal. In presently preferred embodiments, this monitor circuitry includes first and second block monitors electrically connectable to respective of the adjacent track blocks. When the wake-up signal is detected, the switching circuitry responsively resumes normal operation of the track circuit apparatus by removing the power supply shutdown signal and returning continuity to the energy supply line used to power the fail-over systems.

DETAILED DESCRIPTION OF PRESENTLY PREFERRED EMBODIMENTS

Figure 1:
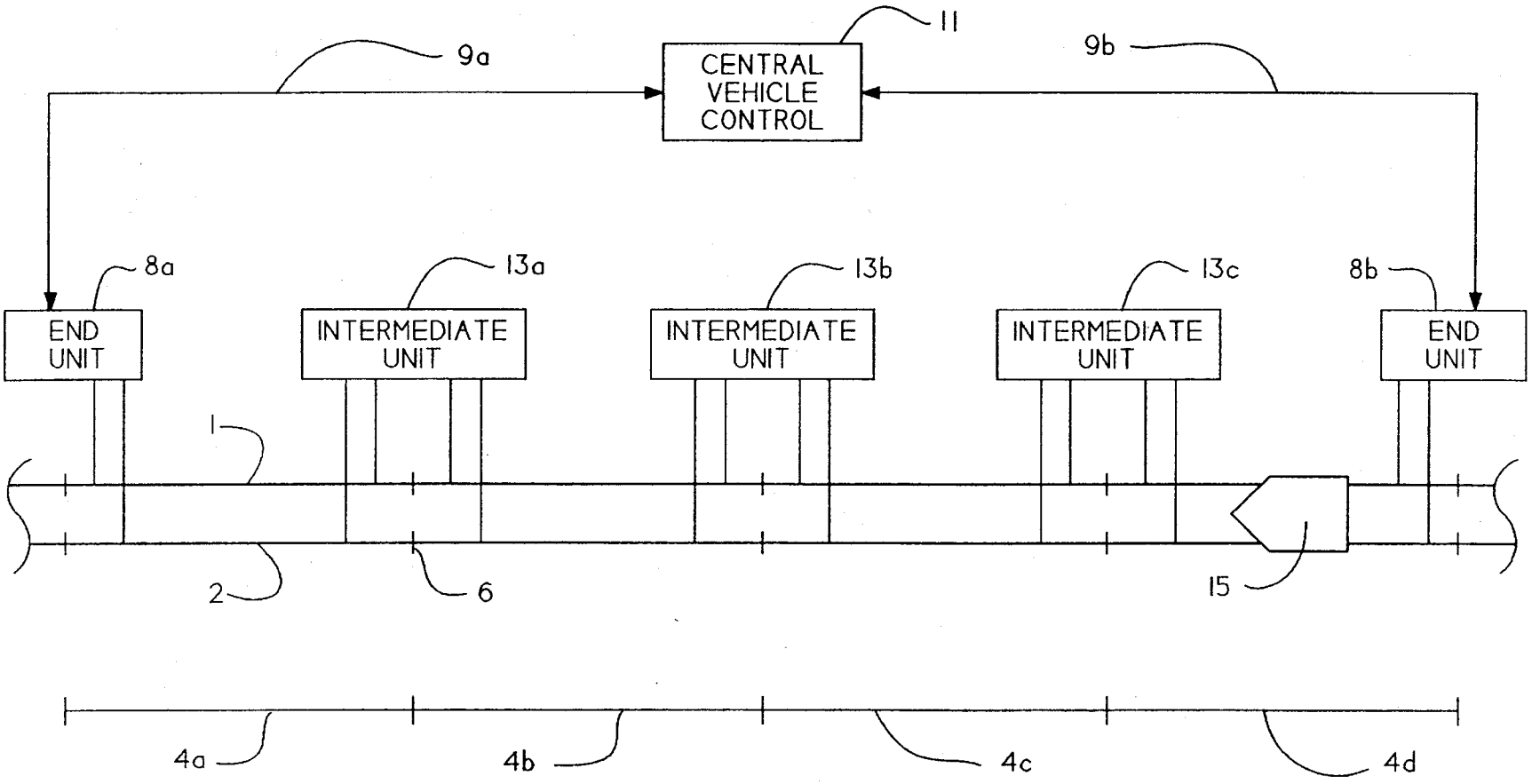
FIG. 1 is a diagrammatic representation of a railway vehicle moving through signalled railway territory incorporating the teachings of the present invention.

FIG. 1 illustrates a signalled railway territory incorporating the teachings of the present invention. A section of track route having rails 1 and 2 is divided into a series of track blocks (shown adjacent 4*a–d*) by insulated joints such as joint 6. Track circuit apparatus are attached to rails 1 and 2 at respective ends of each track block to impress thereon coded signals containing data. Depending on location within the signalled territory, the track circuit apparatus is functionally categorized as either an end unit or intermediate unit. End units 8*a–b* define the perimeters of the signalled territory and are thus attached to rails 1 and 2 at terminal locations in the track route. Two-way links 9*a–b* respectively provide communication between end units 8*a–b* and central vehicle control location 11. Intermediate units 13*a–c* are connected to the track route at interior sections of the signalled territory and function to couple information around the respective insulated joints.

During periods of low vehicle activity, intermediate units 13*a–c* are placed into a reduced power standby mode. In the standby mode, for example, normal track circuit signals may not be transmitted or may be transmitted at a reduced rate so that overall energy consumption is reduced. The standby mode is initiated by one of end units 8*a–b* following verification that blocks 4*a–d* are unoccupied and that no route has been requested through the signalled territory. As an example, initiation of the standby mode by end unit 8*a* will be illustrated. Under these conditions, end unit 8*a* sends a preselected standby initiation signal to intermediate unit 13*a*. Intermediate unit 13*a* reacts by retransmitting this same message to intermediate unit 13*b* and then placing itself into the standby mode. Similarly, intermediate unit 13*b* retransmits the standby initiation signal to intermediate unit 13*c* and goes into the standby mode. Finally, intermediate unit 13*c* sends the standby initiation signal to end unit 8*b*, before also placing itself into the standby mode. End unit 8*b*, and consequently location 11, is thus informed that all of intermediate units 13*a–c* are in the standby mode.

Before a vehicle, such as railway vehicle 15, is allowed to pass through this territory, a route must first be requested from location 11 via one of end units 8*a–b*. To set up this route, all of intermediate units 13*a–c* are reset from standby mode to normal operation. For example, end unit 8*b* accomplishes this by first sending a preselected wake-up signal to intermediate unit 13*c*. Intermediate unit 13*c* reacts by returning to normal operation and transmitting a wake-up signal to intermediate unit 13*b*. Similarly, intermediate unit 13*b* returns to normal operation and transmits a wake-up signal to intermediate unit 13*a*. When intermediate unit 13*a* resumes normal operation, ultimate communication between end unit 8*a* and end unit 8*b* is re-established. The route can now be set up and the railway vehicle sent through.

Figure 2:
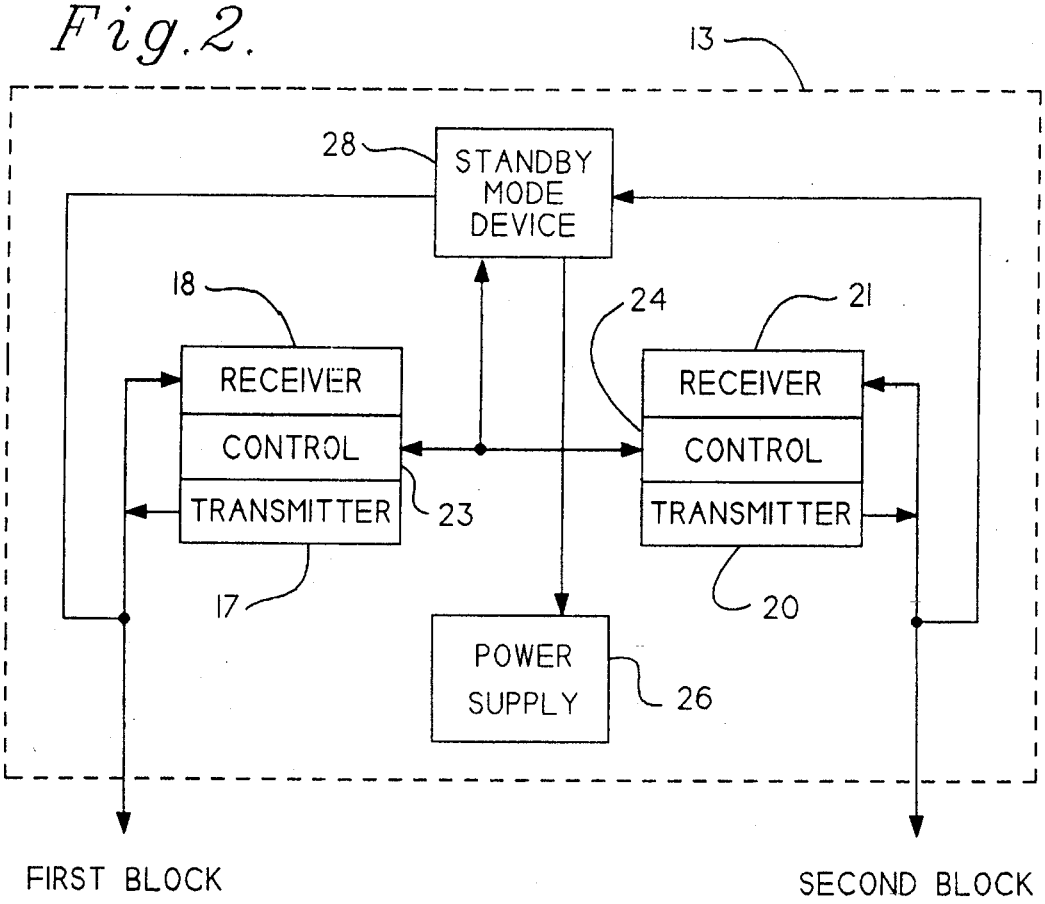
FIG. 2 is a functional block diagram of a coded track circuit apparatus including means of the invention for providing reduced power standby mode capability during periods of low vehicle activity.

Referring to FIG. 2, an intermediate unit 13 constructed to have this reduced power standby mode is diagrammatically illustrated. Transmitter 17 and receiver 18 respectively pass signal information to and from a first block of adjacent track blocks coupled by unit 13. Similarly, transmitter 20 and receiver 21 pass signal information to and from a second block of the adjacent track blocks. Control 23 is provided to direct the alternate flow of information placed onto the first block by transmitter 17 or received therefrom by receiver 18. Operation of transmitter 20 and receiver 21 is likewise governed by control 24. Although shown as separate for purposes of illustration, controls 23 and 24 may actually be incorporated into the operation of a single microprocessor.

Energy to operate unit 13 is supplied by power supply 26, which may include conditioning circuitry for an external power source as well as self-contained power sources, such as storage batteries. In presently preferred embodiments, power supply 26 comprises a switching-regulator type power supply controlled by a feedback loop. Such a power supply is manufactured by Absopulse Electronics, Ltd. of Carp, Ontario, Canada under the model designation USW-3077.

The standby mode capability of the invention is provided by standby mode device 28, which may be built into unit 13 at the time of manufacture or added later as a retrofit option. Preferably, device 28 may be mounted on a printed circuit board suitable for placement in a card file. Upon receipt by unit 13 of the standby initiation signal, standby means within device 28 interrupt regular functioning of power supply 26. This may be accomplished with the above-mentioned switching-regulator type power supply by supplying a power supply shutdown signal. This signal may be applied so that the feedback loop is saturated, thereby causing the power supply to largely cease operation. During the standby mode, monitor means actively await occurrence of the wake-up signal in the adjacent track blocks. When the wake-up signal is received, normal operation of power supply 26 is resumed.

Figure 3A:
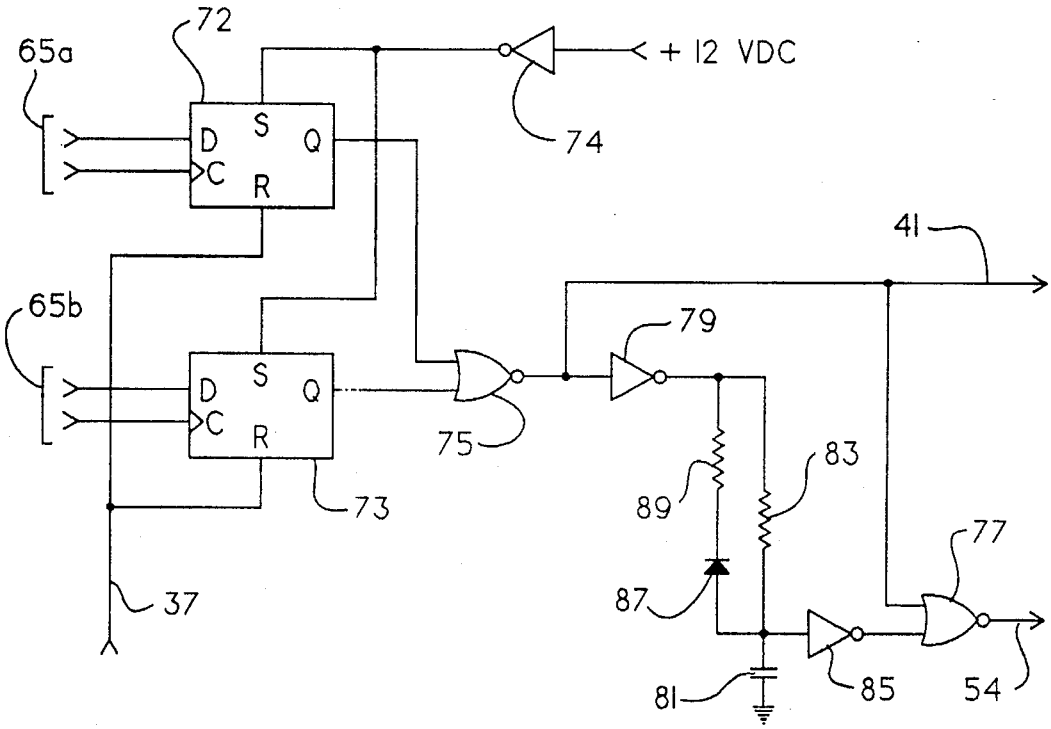
FIG. 3A is a schematic diagram of the switching circuitry illustrated diagrammatically in FIG. 3.
Figure 3:
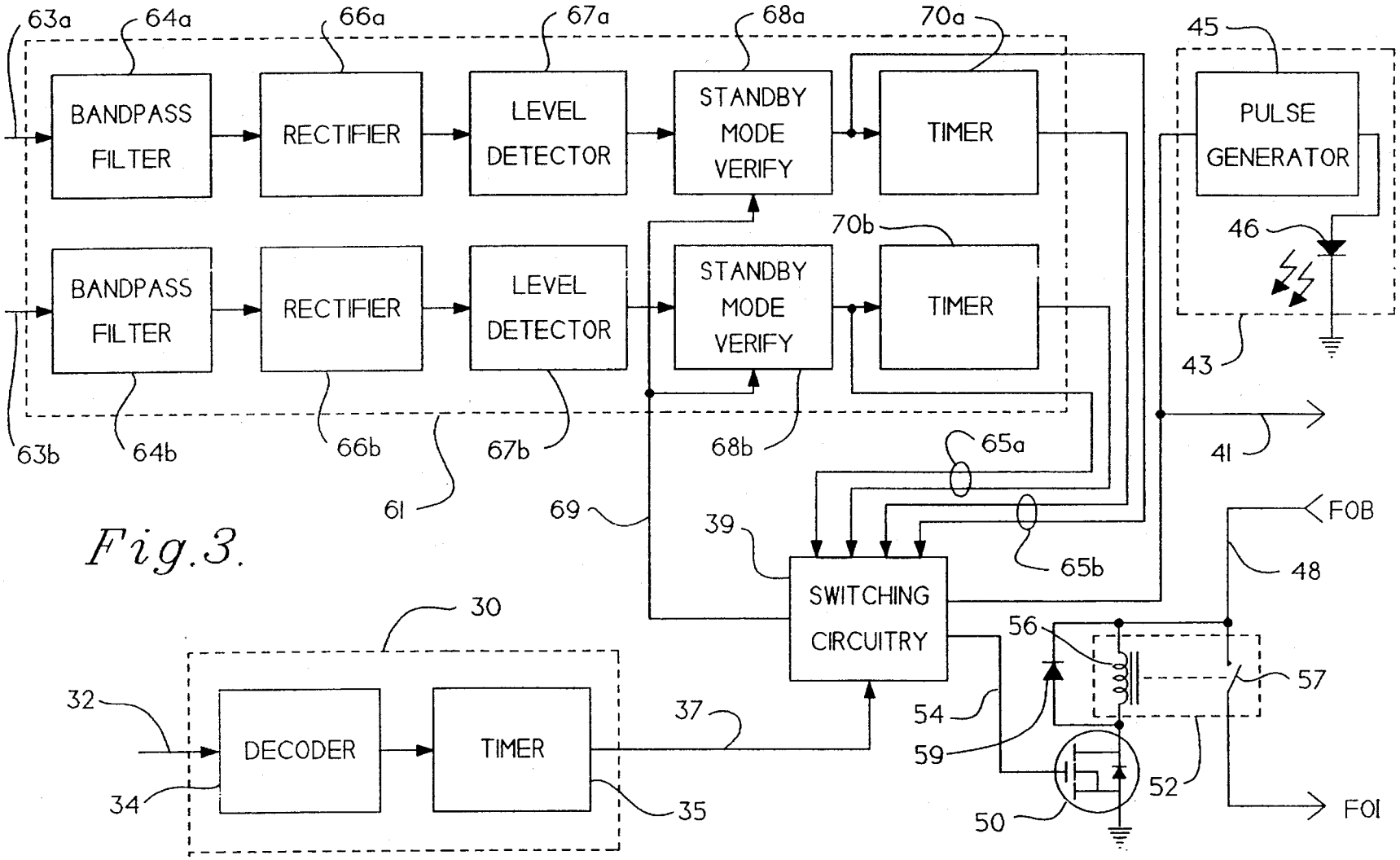
FIG. 3 is a diagrammatic representation of presently preferred circuitry capable of providing a coded railway track circuit apparatus with operation in the reduced power standby mode.

A presently preferred embodiment of standby mode device 28 is illustrated in FIG. 3. A signal based on the standby initiation signal transmitted in the rail is received by standby initiation circuitry 30 on line 32. This signal is "based on" the standby initiation signal since it may actually be the standby initiation signal in the rails or another signal produced by controls 23 and 24 in response to receipt of the standby initiation signal. If the signal received on line 32 is identified by decoder 34 as indeed being the expected signal such as a preselected tone, and the signal is maintained for a duration determined by timer 35, a standby actuation signal is output on line 37 to switching circuitry 39. Switching circuitry 39 responds by outputting on line 41 a power supply shutdown signal.

To provide indication that unit 13 has been placed into the standby mode, the signal on line 41 may also be fed to a standby mode indicator circuit 43. While standby mode indicator circuit may include many types of visual display elements and associated driving circuitry, presently preferred embodiments utilized a pulse generator 45 supplying a stream of pulses to cause flashing of light emitting diode 46.

In the event of an undesired power failure, track circuit apparatus such as unit 13 are generally equipped with fail-over systems which operate to then display a restrictive condition in the associated track block. Such systems are typically powered by fail-over batteries ("FOB") maintained within unit 13. To prevent the actuation of the fail-over indicators ("FOI") and the concomitant energy drain while in the standby mode, fail-over interrupt circuitry may be provided to suspend continuity in fail-over energy supply line 48. As illustrated, this fail-over interrupt circuitry may include a n-channel enhancement metaloxide semiconductor field effect transistor ("MOSFET") 50 driving a normally open relay 52. During normal operation of unit 13, switching circuitry 39 will maintain via line 54 a digital "high" voltage level on the gate of MOSFET 50. As such, current will flow through coil 56 of relay 52, thus maintaining switch 57 in a closed position. During the standby mode, however, the voltage level on line 54 drops to a digital "low." As a result of this fail-over interrupt signal, MOSFET 50 will no longer conduct current through coil 56. Thus, switch 57 will open. Anti-parallel diode 59 is connected across coil 56 to suppress voltage spikes which may be induced by the switching action of MOSFET 50.

During the standby mode, monitor circuitry 61 awaits reception of the wake-up signal. The wake-up signal may be a unique signal or a link-up signal such as is periodically transmitted by some coded track circuit units during periods when the block is occupied. U.S. Pat. No. 5,145,131 issued Sep. 8, 1992 to Raymond C. Franke discusses a coded track circuit apparatus utilizing link-up signals to re-establish communication after an interruption. In presently preferred embodiments, monitor circuitry 61 comprises substantially identical first and second block monitors respectively connected to the adjacent track blocks via lines 63*a* and 63*b*. When a wake-up signal is received in one of these blocks, the respective block monitor produces at least one normal operation actuation signals which are applied to switching circuitry 69 such as via lines 65*a* and 65*b*. As a result, switching circuitry 69 removes the power supply shutdown signal on line 41 and the voltage on line 54 returns to its quiescent digital "high" state.

Each of the track monitors includes a number of circuits which together operate to receive a wake-up signal and produce the normal operation actuation signals. In presently preferred embodiments, it is contemplated that the wake-up signal will be in the form of an alternating current pulse of preselected duration and frequency. Thus, each track monitor includes bandpass filters 64*a–b* generally having as a resonant frequency the frequency of the wake-up signal. The outputs of bandpass filters 64*a–b* are fed to the respective of rectifiers 66*a–b*, the outputs of which are respectively passed to level detectors 67*a–b*. Level detectors 67*a–b* each produce a triggered output signal if the rectified signals at their inputs exceed a preselected threshold. The triggered output signals are then fed to standby mode verify circuits 68*a–b*.

Standby mode verify circuits 68*a–b* are configured to produce an output signal only if switching circuitry 39 has supplied via line 69 a verify signal indicating that unit 13 is actually in the standby mode. The function of standby mode verify circuits 68*a–b* may be accomplished by digital logic circuits, such as NOR gates. If the output of standby mode verify circuits 68*a–b* is maintained for a duration sufficient to overcome a preselected time delay determined by timer circuits 70*a–b*, switching circuitry 39 will resume normal operation of track circuit apparatus 13. The delay selected for timers 70*a–b* should be sufficient to provide a degree of certainty that the output of standby mode verify circuits 68*a–b* is genuine, but should be of a duration less than that of the wake-up signal.

FIG. 3A illustrates components which may be utilized within switching circuitry 39 to effectuate the described functions. To place unit 13 into the standby mode, the standby actuation signal on line 37 is applied to the reset ("R") inputs of flip-flops 72 and 73. As a result, digital "low" signals are produced at the respective Q outputs, which are connected to the inputs of NOR gate 75. The set ("S") inputs of flip-flops 72 and 73 are maintained at a digital "low" level by inverter 74, which is fed by a twelve volt DC supply. A digital "high" signal produced at the output of NOR gate 75 by the digital "low" state of the Q outputs of flip-flops 72 and 73, can directly function, via line 41, as the power supply shutdown signal. This "high" output of NOR gate 75 is also fed to one input of NOR gate 77. As a result, the voltage on line 54 drops to the desired digital "low."

Normal operation actuation signals produced by the respective track monitors are applied at 65*a* and 65*b* to flipflops 72 and 73. Particularly, each track monitor produces in this case two normal operation actuation signals which are applied to respective data ("D") and clock ("C") inputs. The D input signals are obtained directly from the output of the respective of standby mode verify circuits 68*a* and 68*b*. The C inputs are taken from the respective of timers 70*a* and 70*b*. When the appropriate signals are thus received, a digital "high" output is produced at the respective Q output of flip-flop 72 or 73. A digital "high" signal received at either of the inputs of NOR gate 75 will produce at its output a digital "low" signal. This removes the power supply shutdown signal on line 41, thus permitting resumption of the normal operation of track circuit apparatus 13. In order to not reactivate the fail-over systems until a time sufficient to allow full operation of track circuit apparatus 13 to return, the digital "low" signal on line 54 is temporarily maintained.

To temporarily maintain this digital "low" signal on line 54, the output of NOR gate 75 is also connected to the input of inverter 79. Thus, when the output of NOR gate 75 goes to a digital "low" level, the output of inverter 79 goes to a digital "high" level. As a result, capacitor 81 will begin to charge through resistor 83. When the voltage level on capacitor 81 reaches the digital "high" level, the output of inverter 85 will drop to a digital "low" state. Only at this time, will the output of NOR gate 77 attain a digital "high". Diode 87 and resistor 89 allow capacitor 81 to preparatively discharge when the sleep mode is initiated.

The invention thus provides a method and means for placing a coded railway track circuit apparatus into a reduced power standby mode during periods of low vehicle activity. Depending on the amount of vehicle traffic in the signalled territory, power consumption at the units so equipped can be reduced by an amount generally up to 90%. As a result, the cost of backup batteries is reduced and the use of self-contained battery systems charged by solar panels is facilitated. While certain presently preferred embodiments and methods of practicing the same have been shown and described, it is to be distinctly understood that the invention is not limited thereto but may be otherwise variously embodied and practiced within the scope of the following claims.

I claim:

1. A coded railway track circuit apparatus electrically connectable to rails in first and second track blocks, said apparatus to communicate railway signal information including vehicle presence during normal operation, said apparatus comprising:

first transmitter means for transmitting coded track signals onto said first block;

first receiver means for receiving coded track signals from said first block;

second transmitter means for transmitting coded track signals onto said second block;

second receiver means for receiving coded track signals from said second block;

power supply means for providing operational power to said apparatus;

standby means for placing said apparatus in a reduced power standby mode upon occurrence of a preselected standby initiation signal by operably interrupting normal operation of said power supply means; and monitor means active during the standby mode for returning said apparatus to normal operation upon occurrence of a preselected wake-up signal.

2. The coded railway track circuit apparatus of claim 1 further comprising means for transmitting said wake-up signal onto one of said first and second track blocks upon receipt of said wake-up signal from another of said first and second track blocks.

3. The coded railway track circuit apparatus of claim 1 further comprising means for transmitting said standby initiation signal onto one of said first and second track blocks upon receipt of said standby initiation signal from another of said first and second track blocks.

4. A coded railway track circuit apparatus electrically connectable to rails in first and second track blocks, said apparatus to communicate railway signal information including vehicle presence during normal operation, said apparatus comprising:

first transmitter means for transmitting signals onto said first block;

first receiver means for receiving signals from said first block;

second transmitter means for transmitting signals onto said second block;

second receiver means for receiving signals from said second block;

power supply means for providing operational power to said apparatus;

standby means for placing said apparatus in a reduced power standby mode upon occurrence of a preselected standby initiation signal by operably interrupting normal operation of said power supply means, wherein said standby means further comprises means for interrupting power to fail-over indicators; and monitor means active during the standby mode for returning said apparatus to normal operation upon occurrence of a preselected wake-up signal.

5. The coded railway track circuit apparatus of claim 4 further comprising:

means for transmitting said wake-up signal onto one of said first and second track blocks upon receipt of said wake-up signal from another of said first and second track blocks; and means for transmitting said standby initiation signal onto said one of said first and second track blocks upon receipt of said standby initiation signal from said another of said first and second track blocks.

6. A method of reducing power consumption in a coded railway track circuit apparatus electrically connected to at least one track block, said apparatus to communicate railway signal information including vehicle presence during normal operation, said method comprising the steps of:

(a) monitoring said at least one track block for occurrence of a preselected standby initiation signal;

(b) interrupting full power to said track circuit apparatus in response to said standby initiation signal;

(c) monitoring said at least one track block when full power to said track circuit apparatus is interrupted for occurrence of a preselected wake-up signal; and (d) restoring full power and normal operation to said track circuit apparatus whereby said coded track circuit apparatus communicates coded track signals in response to said wake-up signal.

7. The method of claim 6 further comprising the step of:

(e) retransmitting said standby initiation signal onto a second track block upon receipt of said standby initiation signal in a first of said at least one track block.

8. A method of reducing power consumption in a coded railway track circuit apparatus electrically connected to at least one track block, said apparatus to communicate railway signal information including vehicle presence during normal operation, said method comprising the steps of:

(a) monitoring said at least one track block for occurrence of a preselected standby initiation signal;

(b) interrupting full power to said track circuit apparatus in response to said standby initiation signal;

(c) monitoring said at least one track block when full power to said track circuit apparatus is interrupted for occurrence of a preselected wake-up signal;

(d) restoring full power and normal operation to said track circuit apparatus in response to said wake-up signal;

(e) retransmitting said standby initiation signal onto a second track block upon receipt of said standby initiation signal in a first of said at least one track block;

(f) interrupting power to fail-over indicators in response to said standby initiation signal; and (g) restoring power to said fail-over indicators in response to said wake-up signal.

9. A device operable to place a coded railway track circuit apparatus having a power supply into a reduced power standby mode by interrupting regular functioning of said power supply upon occurrence of a standby initiation signal and operable to return said track circuit apparatus to normal operation communicating railway signal information including vehicle presence, upon occurrence of a wake-up signal, said device comprising:

standby initiation means for receiving and identifying said standby initiation signal;

monitor means active during the standby mode for receiving and identifying said wake-up signal;

switching means responsive to said standby initiation means for interrupting regular functioning of said power supply; and said switching means further responsive to said monitor means for returning regular functioning of said power supply in communicating coded track signals.

10. The device of claim 9 wherein said standby initiation means comprises:

a decoder to receive said standby initiation signal and operable to produce only in response thereto a decoder output signal; and a timer circuit to receive said decoder output signal and operable to produce a standby actuation signal only if said decoder output signal is maintained for a preselected duration.

11. The device of claim 9 wherein said coded railway track circuit apparatus is connected to adjacent track blocks and wherein:

said monitor means comprises first and second block monitors to monitor the respective of said adjacent track blocks; and each of said block monitors being operable to produce at least one respective normal operation actuation signal upon receipt of said wake-up signal.

12. A device operable to place a coded railway track circuit apparatus having a power supply into a reduced power standby mode by interrupting regular functioning of said power supply upon occurrence of a standby initiation signal and operable to return said track circuit apparatus to normal operation communicating railway signal information including vehicle presence, upon occurrence of a wake-up signal, said device comprising:

standby initiation means for receiving and identifying said standby initiation signal;

monitor means active during the standby mode for receiving and identifying said wake-up signal;

switching means responsive to said standby initiation means for interrupting regular functioning of said power supply;

said switching means further responsive to said monitor means for returning regular functioning of said power supply; and fail-over interrupt means responsive to said switching means for suspending continuity in a fail-over energy supply line.

13. The device of claim 12 further comprising a standby mode indicator means responsive to said switching means in said standby mode for actuating a visual display element.

14. A device operable to place a coded railway track circuit apparatus having a power supply into a reduced power standby mode by interrupting regular functioning of said power supply upon occurrence of a standby initiation signal and operable to return said track circuit apparatus to normal operation communicating railway signal information including vehicle presence, upon occurrence of a wake-up signal, said device comprising:

standby initiation means for receiving and identifying said standby initiation signal;

monitor means active during the standby mode for receiving and identifying said wake-up signal;

switching means responsive to said standby initiation means for interrupting regular functioning of said power supply; and said switching means further responsive to said monitor means for returning regular functioning of said power supply; wherein said coded railway track circuit apparatus is connected to adjacent track blocks and wherein:

said monitor means comprises first and second block monitors to monitor the respective of said adjacent track blocks; and each of said block monitors being operable to produce at least one respective normal operation actuation signal upon receipt of said wake-up signal and wherein:

said switching means further produces a standby mode verify signal; and said first and second block monitors are each electrically connected to receive said standby mode verify signal and are operative to produce normal operation actuation signals only when said standby mode verify signal is received.

15. A device operable to place a coded railway track circuit apparatus having a power supply into a reduced power standby mode by interrupting regular functioning of said power supply upon occurrence of a standby initiation signal and operable to return said track circuit apparatus to normal operation communicating railway signal information including vehicle presence, upon occurrence of a wake-up signal, said device comprising:

standby initiation means for receiving and identifying said standby initiation signal;

monitor means active during the standby mode for receiving and identifying said wake-up signal;

switching means responsive to said standby initiation means for interrupting regular functioning of said power supply, said switching means further responsive to said monitor means for returning regular functioning of said power supply; and standby mode indicator means responsive to said switching means in said standby mode;

wherein said coded railway track circuit apparatus is connected to adjacent track blocks and wherein:

said monitor means comprises first and second block monitors to monitor the respective of said adjacent track blocks; and each of said block monitors being operable to produce at least one respective normal operation actuation signal upon receipt of said wake-up signal;

wherein said switching means further produces a standby mode verify signal and wherein each of said first and second block monitors further comprises:

a bandpass filter connected to a respective one of said adjacent track blocks, said bandpass filter tuned to a preselected resonant frequency and operable to pass an AC output signal only when receiving an AC input signal generally having a frequency of said preselected resonant frequency;

a rectifier electrically connected to receive said AC output signal and operable to produce a rectified output signal;

a level detector electrically connected to receive said rectified output signal and operable to produce a triggered output signal only when said rectified output signal exceeds a preselected threshold;

a standby mode verify circuit electrically connected to receive said triggered output signal and said standby mode verify signal, said standby mode verify circuit operable to produce a standby output signal based on said triggered output signal only when a standby mode indication signal produced by said standby mode indicator means is present; and a timer circuit electrically connected to receive said standby output signal of said standby mode verify circuit and operable to produce at least one of said normal operation actuation signals only when said standby output signal of said standby mode verify circuit is maintained for a preselected duration.

* * * * *